US009650901B2

(12) United States Patent
Zhang et al.

(10) Patent No.: US 9,650,901 B2
(45) Date of Patent: May 16, 2017

(54) TURBINE DAMPER

(75) Inventors: Qingxuan Michael Zhang, San Diego, CA (US); Theresa A. Brown, San Diego, CA (US); Leslie John Faulder, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 1361 days.

(21) Appl. No.: 13/485,789

(22) Filed: May 31, 2012

(65) Prior Publication Data

US 2013/0323031 A1 Dec. 5, 2013

(51) Int. Cl.
*F01D 5/22* (2006.01)
*F01D 5/30* (2006.01)

(52) U.S. Cl.
CPC ..... *F01D 5/22* (2013.01); *F01D 5/3015* (2013.01); *Y10T 29/4932* (2015.01)

(58) Field of Classification Search
CPC ... F01D 5/22; F01D 5/26; F01D 5/081; F01D 5/3007; F01D 11/005; F01D 11/006; F01D 11/008; F01D 25/06; F05D 2260/96
See application file for complete search history.

(56) References Cited

U.S. PATENT DOCUMENTS 2,478,292 A * 8/1949 Lofgren ..... B02C 18/305 241/82.1
3,112,915 A 12/1963 Morris
3,266,771 A * 8/1966 Morley ..... F01D 5/22 416/190
3,610,778 A 10/1971 Suter
3,666,376 A * 5/1972 Moody ..... F01D 5/22 416/219 R
3,700,354 A * 10/1972 Memery ..... 416/219 R
3,751,183 A 8/1973 Nichols et al.
3,887,298 A * 6/1975 Hess et al. ..... 416/220 R
3,918,842 A * 11/1975 Longley et al. ..... 416/219 R
3,936,216 A * 2/1976 Dixon ..... 415/116
4,101,245 A * 7/1978 Hess ..... F01D 5/22 416/190
4,182,598 A 1/1980 Nelson
4,343,594 A * 8/1982 Perry ..... F01D 5/3015 416/193 A
4,473,337 A * 9/1984 Leonardi ..... F01D 5/22 416/193 A
4,505,640 A * 3/1985 Hsing ..... F01D 5/187 416/219 R (Continued)

FOREIGN PATENT DOCUMENTS

CN 102227545 10/2011
CN 102317579 1/2012

*Primary Examiner* — Gregory Anderson
*Assistant Examiner* — Wayne A Lambert
(74) *Attorney, Agent, or Firm* — Finnegan, Henderson, Farabow, Garrett & Dunner, LLP

(57) ABSTRACT

A damper for a turbine rotor assembly of a gas turbine engine is disclosed. The damper includes a width dimension, a height dimension, and a length dimension and a forward plate. The damper further includes an aft plate that is larger than the forward plate along the width and height dimension and having a lower portion including two legs extending in the height dimension. The damper also includes a longitudinal structure extending in the length dimension and connecting the forward plate and the aft plate.

3 Claims, 5 Drawing Sheets

(56) References Cited

U.S. PATENT DOCUMENTS

| | | | | | |
|---|---|---|---|---|---|
| 4,659,285 | A * | 4/1987 | Kalogeros et al. | 416/95 | |
| 5,161,949 | A | 11/1992 | Brioude et al. | | |
| 5,201,849 | A | 4/1993 | Chambers et al. | | |
| 5,228,835 | A | 7/1993 | Chlus | | |
| 5,388,962 | A | 2/1995 | Wygle et al. | | |
| 5,425,622 | A * | 6/1995 | Murray | F01D 5/3007 | 416/217 |
| 5,478,207 | A | 12/1995 | Stec | | |
| 5,513,955 | A | 5/1996 | Barcza | | |
| 5,573,375 | A | 11/1996 | Barcza | | |
| 5,630,703 | A * | 5/1997 | Hendley et al. | 416/95 | |
| 5,749,706 | A * | 5/1998 | Maar | F01D 5/323 | 29/512 |
| 5,785,499 | A * | 7/1998 | Houston | F01D 11/008 | 416/248 |
| 5,827,047 | A * | 10/1998 | Gonsor | F01D 5/22 | 416/193 A |
| 5,924,699 | A * | 7/1999 | Airey | F01D 11/008 | 277/411 |
| 7,097,429 | B2 | 8/2006 | Athans et al. | | |
| 7,374,400 | B2 * | 5/2008 | Boswell | F01D 5/084 | 416/190 |
| 8,011,892 | B2 | 9/2011 | Ramlogan et al. | | |
| 2006/0013691 | A1 | 1/2006 | Athans et al. | | |
| 2008/0181767 | A1 * | 7/2008 | Brillert et al. | 415/170.1 | |
| 2008/0286106 | A1 * | 11/2008 | Keith | F01D 5/147 | 416/193 A |
| 2009/0022592 | A1 * | 1/2009 | Liotta et al. | 416/220 R | |
| 2010/0111700 | A1 | 5/2010 | Kim et al. | | |
| 2010/0158686 | A1 | 6/2010 | Kim et al. | | |
| 2011/0243709 | A1 | 10/2011 | El-Aini et al. | | |
| 2012/0121434 | A1 | 5/2012 | Kim et al. | | |

* cited by examiner

TURBINE DAMPER

TECHNICAL FIELD

The present disclosure relates generally to a turbine damper and, more particularly, to a turbine damper for regulating the flow of gas through a turbine rotor assembly.

BACKGROUND

A gas turbine engine ("GTE") is known to include a turbine assembly having one or more turbine rotor assemblies mounted on a drive shaft. Each turbine rotor assembly includes a plurality of turbine blades extending radially outward and spaced circumferentially from one another around a turbine rotor. The GTE ignites a mixture of air and fuel to create a flow of high-temperature compressed gas over the turbine blades, which causes the turbine blades to rotate the turbine rotor assembly. Rotational energy from each turbine rotor assembly may be transferred to the drive shaft to power a load, for example, a generator, a compressor, or a pump.

A turbine blade typically includes a root structure and an airfoil extending from opposite sides of a turbine blade platform. The turbine rotor includes a slot for receiving the root structure of each turbine blade. The shape of each slot may be similar in shape to the root structure of each turbine blade. When a plurality of turbine blades are assembled on the turbine rotor, an under-platform cavity may be formed between and beneath turbine platforms of adjacent turbine blades.

Components positioned within the under-platform cavity for regulating the flow of compressed gas around turbine rotor assemblies are known. One example of such a component is described in U.S. Pat. No. 7,097,429 to Athans et al. ("the '429 patent"). The '429 patent discloses a rotor disk including a plurality of turbine blades. Each turbine blade includes an airfoil, a platform, and a shank. The shank may extend down to a multi-lobe dovetail to mount the turbine blade to the rotor disk. A seal body is positioned between the shanks and below the platforms of adjacent turbine blades. The seal body includes an enlarged seal plate disposed at a forward end of the seal body. The enlarged plate overlaps portions of forward faces of adjacent turbine blade shanks to provide a seal. The seal body also includes an aft end with a generally rectangular head disposed above a pair of axial lobes. The aft end head has an area that is smaller than the seal plate at the forward end.

SUMMARY

The present disclosure provides a damper for a turbine rotor assembly of a gas turbine engine. The damper includes a width dimension, a height dimension, and a length dimension and a forward plate. The damper further includes an aft plate that is larger than the forward plate along the width and height dimension and having a lower portion including two legs extending in the height dimension. The damper also includes a longitudinal structure extending in the length dimension and connecting the forward plate and the aft plate.

The present disclosure further provides a damper for a turbine rotor assembly of a gas turbine engine. The damper includes a width dimension, a height dimension, and a length dimension, and a forward plate. The damper further includes an aft plate including a larger area than the forward plate along the width and height dimension, a lower portion including two legs extending in the height dimension, the two legs being separated from one another by a v-shaped gap, and a foot portion extending in the width dimension away from the v-shaped gap, the foot portion located at a lowermost portion of the aft plate. The damper also includes a rectangular-shaped discourager extending aft in the length dimension from the aft plate and a longitudinal structure extending in the length dimension and connecting the forward plate and the aft plate. The longitudinal structure has a width that increases from forward to aft.

The present disclosure also provides a gas turbine engine having a turbine rotor assembly. The turbine rotor assembly includes a turbine rotor having a plurality of turbine blade slots, and a plurality of turbine blades having an airfoil, a platform, and a root structure, the root structure of each turbine blade shaped to be received in a corresponding turbine blade slot of the turbine rotor. The turbine rotor assembly also includes a root-slot gap formed between the root structures of the turbine blades and corresponding turbine blade slots of the turbine rotor, and an under-platform cavity formed between an outer radial surface of the rotor and adjacent turbine blade root structures, and below adjacent turbine blade platforms. The turbine rotor assembly also includes a turbine damper located within at least one of the under-platform cavities. The turbine damper includes a width dimension, a height dimension, and a length dimension, a forward plate sized to provide a forward flow gap into the under platform cavity and the root-slot gap, and an aft plate sized to cover a portion of the under platform cavity and a portion of the root-slot gap.

The present disclosure also provides a method of assembling a turbine rotor assembly having a turbine rotor including a plurality of axially extending turbine blade slots; a plurality of turbine blades each having an airfoil, a platform, and a root structure; and a turbine damper having a forward plate, aft plate, and longitudinal structure connecting the forward plate and the aft plate. The method further includes inserting the root structures of a plurality of turbine blades into a plurality of turbine blade slots; and covering substantially all aft-side gaps between the root structures and the turbine blade slots with a plurality of the turbine dampers.

DETAILED DESCRIPTION

Figure 1:
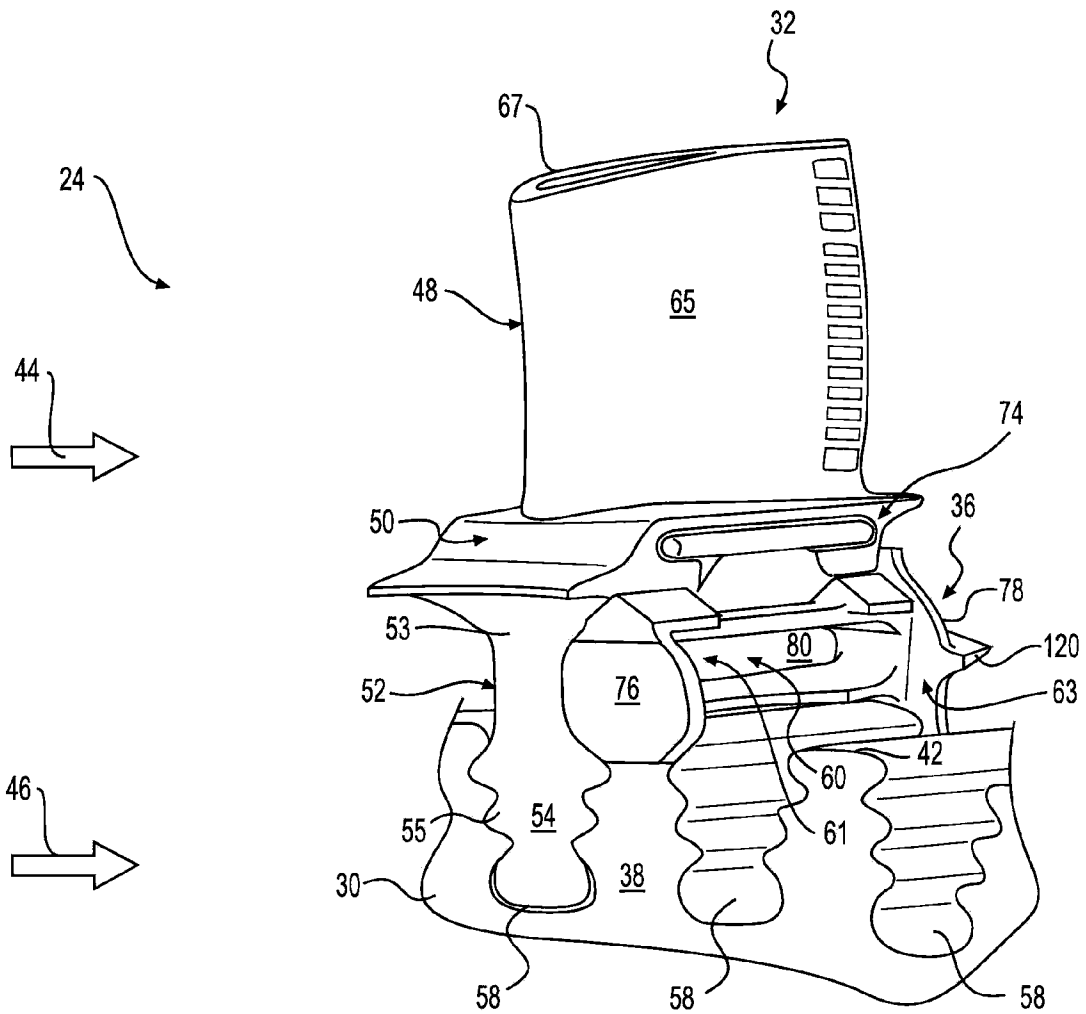
FIG. 1 is a diagrammatic illustration of a partial turbine rotor assembly, including an exemplary turbine damper.

Referring to FIG. 1, a gas turbine engine (GTE) may include a turbine assembly including one or more turbine rotor assemblies (or turbine disk assemblies) 24 mounted on a drive shaft (not shown). Turbine rotor assembly 24 may include, for example, a turbine rotor or disk 30, a turbine blade 32, and a turbine damper 36. For the purposes of this description, reference to "inner" and "outer" refers to radially inner and radially outer positions with respect to a rotational axis of the turbine rotor 30. Also, the term "forward" refers to upstream locations in the flow of fluid through the GTE, and "aft" refers to downstream locations. A plurality of turbine rotor assemblies 24 may be axially aligned on the drive shaft to form a plurality of turbine stages of the GTE. FIG. 1 illustrates the relative positions of turbine blade 32 and damper 36 on turbine rotor 30 at an angled view from a generally forward to aft direction. Although turbine rotor assembly 24 is illustrated in FIG. 1 with a single turbine blade 32 and a single damper 36, it is understood that each turbine rotor assembly 24 includes a plurality of turbine blades 32 and a plurality of associated dampers 36 positioned circumferentially around turbine rotor 30.

Figure 6:
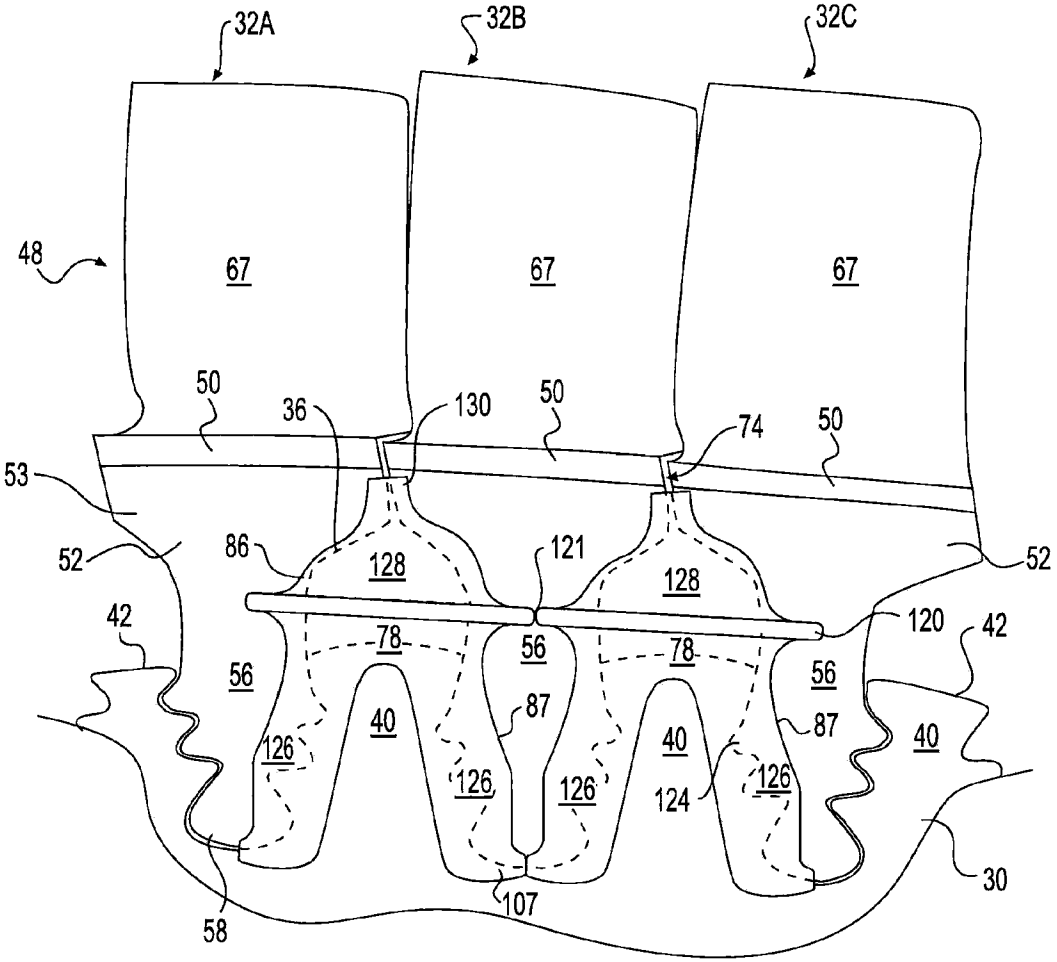
FIG. 6 is a diagrammatic illustration of the turbine rotor assembly of FIG. 1 with an additional turbine blade, looking at the aft face of the turbine rotor assembly.

As illustrated in FIG. 1, a turbine blade 32 may include an airfoil 48 extending up from a platform 50. Airfoil 48 may include a concave airfoil surface 65 on one side, and a convex airfoil surface 67 on the opposite side (FIG. 6). Further, each turbine blade 32 may also include a root structure 52 extending down from platform 50. Root Structure 52 has a forward face 54 and an aft face 56 (FIG. 6). Forward face 54 and concave airfoil surface 65 may generally face the same direction corresponding to a forward or upstream portion of the turbine rotor assembly 24. Aft face 56 and convex airfoil surface 67 may generally face opposite of forward face 54, corresponding to an aft or downstream portion of the turbine rotor assembly 24. Root structure 52 may also include a shank 53 and a lower portion 55. Lower portion 55 of root structure 52 may have a fir-tree type shape providing a series of lobes spaced from each other in the radial direction.

Turbine rotor 30 is configured to receive a plurality of turbine blades 32, spaced radially apart in corresponding slots 58. Turbine rotor 30 includes a forward face 38, an aft face 40 (FIG. 6), and a circumferential outer edge 42. Slots 58 extend axially from forward face 38 to aft face 40. Slots 58 are also configured to mate with and secure a corresponding root structure 52 of a turbine blade 32.

When a pair of turbine blades 32 are mounted in adjacent slots 58 of turbine rotor 30, an under-platform cavity 60 is formed between shanks 53 of adjacent root structures 52, below adjacent platforms 50, and above circumferential outer edge 42 of turbine rotor 30. Under-platform cavity 60 may include a forward end 61 adjacent forward face 38 of turbine rotor 30, and an aft end 63 adjacent aft face 40 (FIG. 6) of turbine rotor 30. As will be described below, damper 36 may be located in under-platform cavity 60 between the turbine rotor 30 and two adjacent turbine blades 32.

Figure 2:
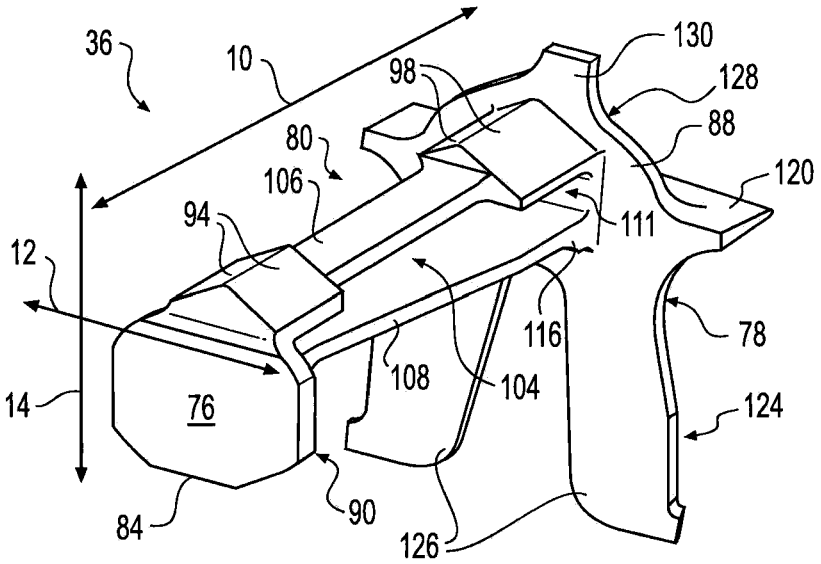
FIG. 2 is a diagrammatic illustration of the exemplary turbine damper of FIG. 1 separate from the turbine rotor assembly and viewed from a forward end.
Figure 3:
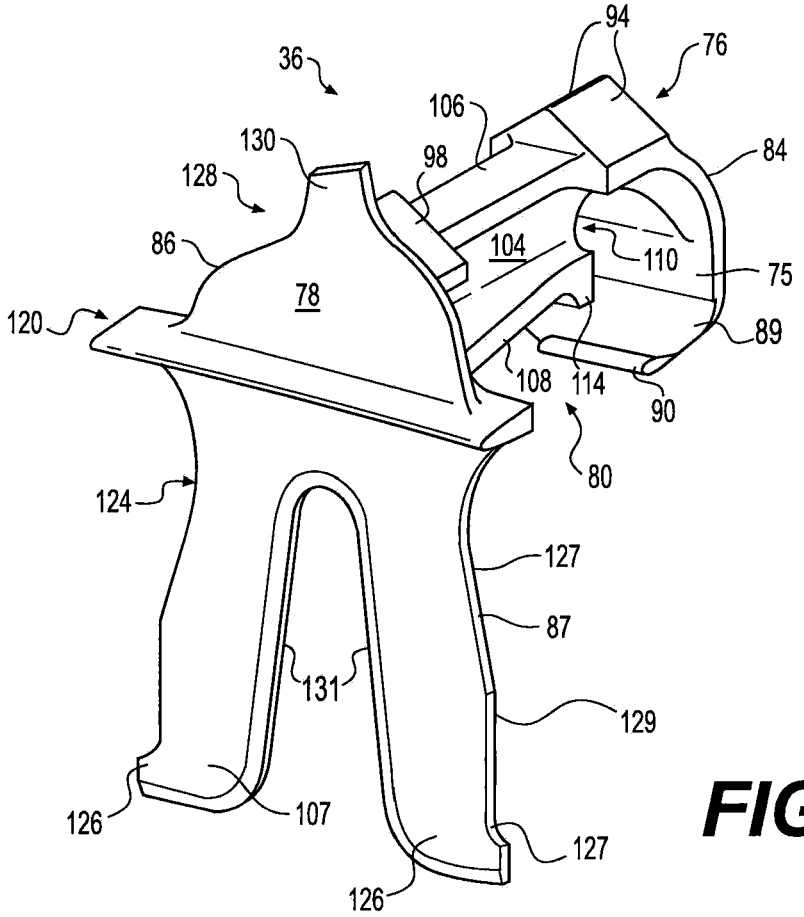
FIG. 3 is the exemplary turbine damper of FIG. 2 viewed from the aft end.

FIGS. 2 and 3 illustrate angled views of damper 36 from the forward end and the aft end, respectively. Damper 36 includes a length dimension 10, a width dimension 12, and a height dimension 14. Damper 36 includes a forward plate 76 and an aft plate 78 connected to each other by a longitudinal structure 80. Aft plate 78 may include a lower extension 124 and an upper extension 128. A rectangular-shaped discourager 120 may extend from the aft plate 78 in the aft direction.

Figure 5:
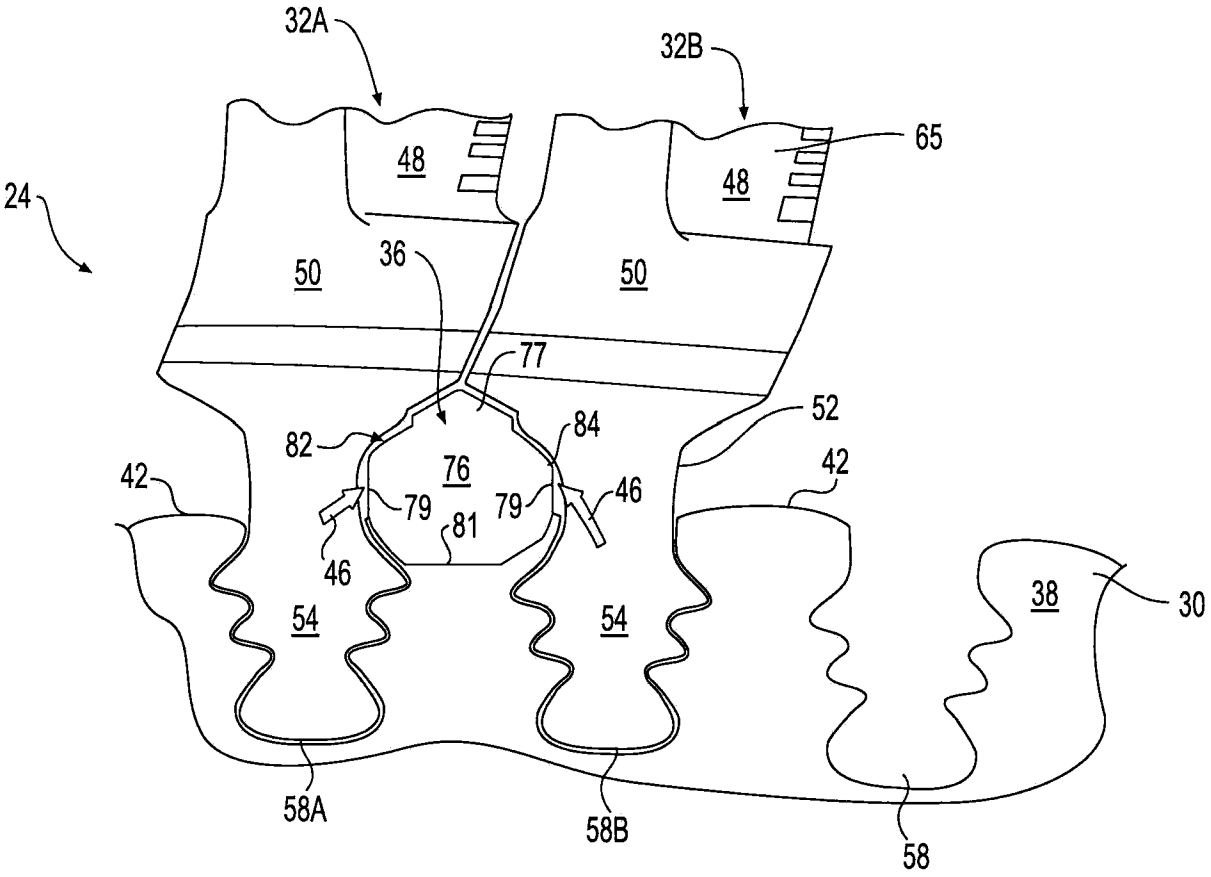
FIG. 5 is a diagrammatic illustration of the turbine rotor assembly of FIG. 1 with an additional turbine blade, looking at a forward face of the turbine rotor assembly.

Referring to FIG. 2, forward plate 76 may have a profile 84 defining an area that is larger than the cross-sectional area of longitudinal structure 80, but is smaller than the area occupied by aft plate 78. That is, the overall width and height of forward plate 76 may be smaller than the overall width and height of aft plate 78. As best seen in FIG. 5, profile 84 of forward plate 76 defines a shape having a tapering upper portion 77 and generally straight side and bottom portions (79, 81). Referring to FIG. 3, an aft face 75 of forward plate 76 may include a side-to-side recess 89 and a biasing lip 90 extending along the width of the bottom edge of forward plate 76. A forward face of forward plate 76 may include a generally flat surface. A forward seating surface 94 may extend in an aft direction from upper portion 77 of forward plate 76. The forward seating surface 94 is shaped into a wedge to mate with the underside geometry of platforms 50 of turbine blades 32.

As noted above, aft plate 78 may include an upper extension 128 and a lower extension 124. Aft plate 78 may be larger than under-platform cavity 60 (i.e., have a larger surface area with lower extension 124 extending substantially beyond aft end 63 of platform cavity 60). An aft seating surface 98 extends in a forward direction from an upper extension 128 of aft plate 78. Aft seating surface 98 is shaped into a wedge that converges on a line that is approximately perpendicular to aft plate 78. Aft seating surface 98 also has a length dimension that is substantially greater than aft plate 78.

Upper extension 128 of aft plate 78 may include an outer edge 86 defining a profile of upper extension 128, and lower extension 124 may include an outer edge 87 defining a profile of lower extension 124. Outer edges 86 and 87 extend out farther than outer edge 84 of forward plate 76 in both the height 14 and width 12 dimensions. The profile of upper extension 128 may be sized to extend to just underneath platform 50.

Figure 4:
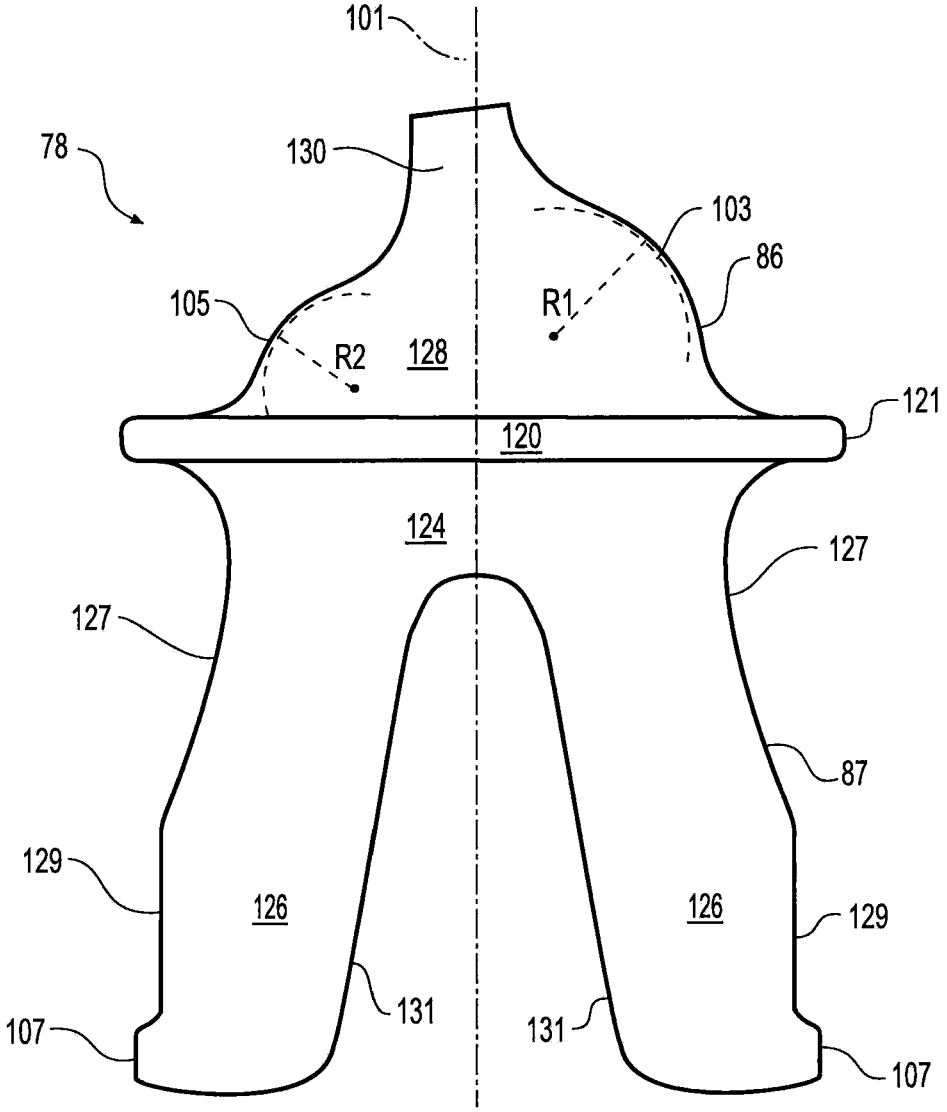
FIG. 4 illustrates an aft end view of the exemplary turbine damper of FIGS. 2 and 3.

As best seen in FIG. 4, upper extension 128 of aft plate 78 may include a non-symmetric profile about a height dimension 14 extending axis 101. In particular, upper extension may include a first convex portion 103 and a second convex portion 105, the first convex portion 103 having a larger radius $R_1$ than a radius $R_2$ of the second convex portion 105. The profile may also decrease in a width dimension 12 along the height dimension 14 to an upper point 130 that may be slightly angled to cover a similarly angled space or gap 74 (FIG. 1) between adjacent turbine blades 32.

A rectangular-shaped discourager 120 may be located between upper extension 128 and lower extension 124. Discourager 120 may extend in a width dimension 12 from one side of aft plate 78 to an opposite side of aft plate 78, and extend in the aft direction to form a fin-like structure. Discourager 120 may have a width that is wider than the upper extension 128. It is understood that discourager 120 may be formed in other shapes and may be omitted.

Lower extension 124 may include a pair of identical legs 126 extending in the height dimension 14. Each leg 126 may be slightly angled in the plane of rotor aft face 40 so that the lower extension 124 generally forms a v-shape and follows the general direction of one half of a gap created between a mating interface of root structures 52 and slots 58. Further, each leg 126 may have a profile including concave portion 127 and straight portion 129. Each leg 126 may also include feet 107 at a lowermost part of each leg 126, the feet 107 extending out in the width dimension 12. Further, each leg 126 may include straight interior edges 131.

Referring again to FIGS. 2 and 3, longitudinal structure 80 of damper 36 may include a central wall 104 and at least one reinforcing structural element. For example, longitudinal structure 80 may include an outer structural element 106 and an inner structural element 108 to provide increased structural rigidity to damper 36. In an exemplary embodiment, longitudinal structure 80 may be substantially I-shaped in cross-section. The outer structural element 106 may include a generally constant width along its length, and inner structural element 108 may include a tapering section that increases in width toward aft plat 78, and a constant width section aft of the tapering section. Longitudinal structure 80 may also include a rounded notch 110 extending into aft face 75 of forward plate 76, for example, through inner structural element 108 and central wall 104. The rounded notch 110 is configured to aid the biasing characteristics of forward plate 76. Longitudinal structure 80 may also include one or more passages (not shown, but generally indicated at 111) extending width-wise through central wall 104 normal to a longitudinal axis of central wall 104. One of the passages 111 may be located against a forward face 88 of aft plate 78. It is also contemplated that longitudinal structure 80 may include one or more inwardly extending feet to rest on circumferential outer edge 42 of turbine rotor 30 during assembly. For example, longitudinal structure 80 may include a forward foot 114 (FIG. 3) and an aft foot 116 (FIG. 2).

FIGS. 5 and 6 illustrate the overall structure of turbine rotor assembly 24 from both a forward view (FIG. 5) and aft view (FIG. 6), including dampers 36. Longitudinal structure 80 is situated just above circumferential outer edge 42 of rotor 30, within under-platform cavity 60 and abutting circumferential outer edge of rotor 42 with forward foot 114 and aft foot 116.

As shown in FIG. 5, damper 36 is positioned between a pair of turbine blades 32A and 32B, and rotor 30. Forward plate 76 is sized such that it is slightly smaller than the forward end 61 of under-platform cavity 60, thereby leaving a gap 82 between forward plate 76 and root structure 52 of adjacent turbine blades 32A and 32B. Likewise, and as is mentioned above, outer edge 84 has a profile that includes a tapered upper portion 77, giving forward plate 76 a wedge-shape feature that follows the angle of the root structure 52 as it approaches the underside of platform 50. FIG. 5 also illustrates the flat side and bottom portions (79, 81) of forward plate 76, terminating below circumferential outer edge of turbine rotor 42, but above the first convex lobe of the fir-tree configuration of root structure 52.

FIG. 6 shows damper 36 positioned between turbine blades 32A, B, and C, and rotor 30. Aft plate 78, in combination with legs 126, covers the gaps formed at the interface of root structure 52 and slots 58 of rotor 30. The gaps are indicated by a dashed lines in FIG. 6. Also, the feet 107 each leg 126 nearly contacts an adjacent leg 126 that is associated with an adjacent damper 36.

Discourager 120 extends in the generally width and length direction. Discourager 120 may extend beyond outer edge of aft plate 78, such that discourager outer edge 121 nearly contacts a second discourager outer edge 121 of an adjacent discourager 120 associated with an adjacent aft plate 78. As is mentioned above, each turbine rotor assembly 24 may include a plurality of turbine blades 32 and a plurality of associated dampers 36 positioned circumferentially around turbine rotor 30. Because of this size and positioning of the plurality of discouragers 120, the discouragers 120 together form a ring around rotor 30. Discourager 120 also extends in the generally aft direction (best shown in FIG. 2). FIG. 6 also shows upper extension 128, above discourager 120, whose slightly angled point 130 allows it to cover the similarly angled gap between and below adjacent turbine platforms 50. The radial height of upper extension 128 is lower than the bottom of platforms 50.

INDUSTRIAL APPLICABILITY

The disclosed turbine rotor assembly 24 may be applicable to any rotary power system, for example, a gas turbine engine. The process of assembling turbine rotor assembly 24 and the process of regulating of the flow of gases 44, 46 past turbine rotor assembly 24 will now be described.

During assembly of turbine rotor assembly 24, each damper 36 may be attached to turbine rotor 30, for example, by an interference fit. In order to position damper 36 on turbine rotor 30, biasing lip 90 of forward plate 76 may be temporarily forced in a direction away from aft plate 78 to provide sufficient clearance for forward and aft plates 76, 78 of damper 36 to fit over circumferential outer edge 42 of turbine rotor 30. Once damper 36 is properly positioned on turbine rotor 30 between one of slots 58, the force on forward plate 76 can be removed to thus clamp damper 36 onto circumferential outer edge 42 of turbine rotor 30.

Turbine blades 32 may be slidably mounted in slots 58 of turbine rotor 30, for example, in a forward-to-aft direction. As shown in FIG. 5, a first turbine blade 32A may be slidably mounted in a first slot 58A of turbine rotor 30 to a side of one of dampers 36. Second turbine blade 32B may be slidably mounted in second slot 58B. Forward plate 76 of damper 36 may provide sufficient clearance to permit first and second turbine blades 32A, 32B to slide into first and second slots 58A, 58B past damper 36. In lieu of installing all of the dampers 36 prior to installing turbine blades 32, it is also contemplated that dampers 36 may be installed on turbine rotor 30 between the installation of adjacent first and second turbine blades 32A, 32B. The process of installing turbine blades 32, and dampers 36 on turbine rotor 30 to form turbine rotor assembly 24 may be repeated until all slots 58 on turbine rotor 30 are occupied by a turbine blade 32.

Once turbine rotor assembly 24 is fully assembled and the GTE is ready for operation, turbine rotor assembly 24 may help regulate the flow of hot gases 44 and the flow of cold gases 46 shown in FIG. 1. During operation of the GTE, a compressor section may draw air into the GTE through an air inlet duct and compress the air before at least a portion of the compressed air enters a combustor section to undergo combustion to form hot gases 44. At least a portion of the of the remaining compressed air, referred to as cold gases 46, may be used for non-combustion purposes (e.g. cooling one or more sections of the GTE) and may travel through the GTE, separated from the portion of compressed air used for combustion purposes. The flow of hot gases 44 may be sent through a turbine section to rotate one or more turbine rotor assemblies 24. The use of the terms "hot" and "cold" in reference to the flow of gases is merely meant to identify that the "flow of hot gases" is generally at a different temperature or pressure than the "flow of cold gases."

As shown in FIG. 1, the flow of hot gases 44 and the flow of cold gases 46 may flow past turbine rotor assembly 24 in a forward to aft direction. The flow of hot gases 44 may usually be separated from the flow of cold gases 46 by a wall (not shown).

At least a portion of the flow of hot gases 44 rotates one or more turbine rotor assemblies 24. But, an ingress of hot gases 44 into under-platform cavity 60 through gap 74 may cause premature fatigue of turbine blades due to excessive heat. To help avoid this, at least a portion of the flow of cold gases 46 is diverted to provide a pressurized fluid within under-platform cavity 60 and/or slot 58 of the turbine rotor assembly 24. A portion of the flow of cold gases 46 may also provide cooling to one or more components of the turbine rotor assembly 24.

To help maintain a positive pressure in the regions under turbine blade platforms 50 and between the forward and aft faces of turbine rotor assemblies 24, it is contemplated that gap 82 at forward end 61 of under-platform cavity 60 may be less restrictive than seals formed at the aft faces of turbine rotor assembly 24. The flow of cold gases 46 may flow past forward faces 54 of root structures 52 and flow through gap 82, formed between outer edge 84 of forward plate 76 and forward face 54 of adjacent root structures 52, and into forward end 61 of under-platform cavity 60. The flow of cold gases 46 that is permitted to enter under-platform cavity 60 may tend to increase the pressure within under-platform cavity 60 and slot 58 to a higher pressure than outside under-cavity platform 60 or outside slot 58. This is due to forward face 88 of aft plate 78, which covers the interface of root structures 52 and slots 58 of rotor 30, limiting the flow of cold gases 46 from exiting aft end 63 of under-platform cavity 60. That is, the flow of cold gases 46 may be restricted at aft end 63 of under-platform cavity 60 from exiting at aft end of platforms 50, and at aft end of slots 58, more than restrictions at the forward end of turbine rotor assembly 24. Since gas flow tends to move from areas of higher pressure to areas of lower pressure, the flow of cold gases 46 under higher pressure below turbine platform 50 may tend to suppress an ingress of the flow of hot gases 44 radially inwardly into under-platform cavity 60.

Referring to FIG. 6, the profile of leg 126 with feet 107 may define a shape that is immediately adjacent edge 87 of another leg 126, associated with a second damper 36. The arrangement ensures additional sealing along root structure 52 and lower portions of slots 58. Also, upper point 130 may have a shape that substantially extends outwardly to provide additional sealing of the gap between aft faces 56. More specifically, upper point 130 of upper extension 128 may cover a portion of two adjacent aft faces of rotor just under platform 50 to accomplish the sealing.

FIG. 6 further illustrates that damper 36 may at least partially restrict the hot flow of gases 44 from flowing downward in a generally radial direction with discourager 120. Because discourager 120 extends in the generally width and length directions, further suppression of air flow mixing between the hot flow and the cold flow is achieved in the aft region of turbine rotor assembly 24. That is, discourager 120 inhibits generally inward radial gas flows because the aft-extending component of discourager 120 acts as a separating wall. Discourager 120 further inhibits gas flow in the radial direction by creating an at least nearly continuous separating wall in the angular direction, since the discourager 120 is aligned with and nearly in contact with adjacent discouragers 120 at outer edges 121 that form a ring around the rotor assembly.

While damper 36 is described and shown in the exemplary embodiments of FIGS. 2 and 3, it is contemplated that other configurations of damper 36 may also be implemented. For example, forward plate 76 of damper 36 may include one or more passages (not shown) for further regulating the flow of cold gases 46 within under-platform cavity 60. Further, damper 36 may include fewer or more extensions to accomplish additional sealing and or retention between turbine rotor assembly components.

It will be apparent to those skilled in the art that various modifications and variations can be made to the disclosed turbine blade assembly without departing from the scope of the disclosure. Other embodiments of the turbine blade assembly will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A gas turbine engine, comprising:

a turbine rotor assembly, the turbine rotor assembly including a turbine rotor having a plurality of turbine blade slots, a plurality of turbine blades having an airfoil, a platform, and a root structure, the root structure of each turbine blade shaped to be received in a corresponding turbine blade slot of the turbine rotor, a root-slot gap formed between the root structures of the turbine blades and corresponding turbine blade slots of the turbine rotor, and an under-platform cavity formed between an outer radial surface of the rotor and adjacent turbine blade root structures, and below adjacent turbine blade platforms; and a turbine damper located within at least one of the under-platform cavities, the turbine damper including:

a width dimension, a height dimension, and a length dimension;

a forward plate sized to provide a forward flow gap into the under-platform cavity and the root-slot gap; and an aft plate sized to cover a portion of the under-platform cavity and a portion of the root-slot gap, wherein the aft plate includes two legs separated from one another by a gap.

2. The gas turbine engine of claim 1, wherein the aft plate is sized to cover substantially all of an aft end of the under platform cavity and substantially half of an aft end of the root-slot gap.

3. The gas turbine engine of claim 2, wherein the aft plate includes an upper portion extending in the height dimension, the upper portion having a non-symmetric configuration and a width that decreases along the height dimension, the upper portion covering at least a portion of an upper tapering gap between and below adjacent turbine blade platforms.

* * * * *